US008973849B1

(12) United States Patent
Connelly, Sr.

(10) Patent No.: US 8,973,849 B1
(45) Date of Patent: Mar. 10, 2015

(54) ATTACHMENT FOR A PRESSURE WASHER

(76) Inventor: Randy E. Connelly, Sr., Germantown, MD (US)

( * ) Notice: Subject to any disclaimer, the term of this patent is extended or adjusted under 35 U.S.C. 154(b) by 567 days.

(21) Appl. No.: 13/345,177

(22) Filed: Jan. 6, 2012

(51) Int. Cl.
*B05B 1/28* (2006.01)

(52) U.S. Cl.
USPC ..... 239/288; 239/600

(58) Field of Classification Search
CPC ..... B05B 1/34; B05B 1/3452
USPC ..... 239/461, 464, 481, 484
See application file for complete search history.

(56) References Cited

U.S. PATENT DOCUMENTS 1,817,644 A 8/1931 Pope
2,723,407 A 11/1955 Bardon
3,677,470 A 7/1972 Probst et al.
3,825,970 A 7/1974 Hanssen
4,770,619 A * 9/1988 Rijkaart ..... 425/96
5,360,165 A 11/1994 Singhal
5,908,163 A 6/1999 Wells
6,776,363 B1 8/2004 Falletta et al.
6,792,639 B2 9/2004 Wilkins
7,063,281 B2 6/2006 Schommer
7,686,752 B2 * 3/2010 Dua et al. ..... 492/14

* cited by examiner

*Primary Examiner* — Davis Hwu
(74) *Attorney, Agent, or Firm* — Lieberman & Brandsdorfer, LLC

(57) ABSTRACT

Embodiments of the invention relate to an attachment for a pressure washer to facilitate cleaning of secondary surfaces. The attachment includes a body with three walls, two of the walls are in a parallel relationship and a third wall is substantially perpendicular to the two parallel walls. A single rolling element is in communication with the two parallel walls and spaced apart from the third wall. The single rolling element may be applied to a secondary surface so that the attachment rolls along the surface thereof while liquid is ejected from the pressure washer to clean the secondary surface.

20 Claims, 4 Drawing Sheets

ATTACHMENT FOR A PRESSURE WASHER

FIELD OF THE INVENTION

The present invention relates to pressure washers for cleaning a secondary surface with a high velocity spray. More specifically, the present invention is an attachment for a pressure washer to facilitate cleaning secondary surfaces.

BACKGROUND

A pressure washer is a mechanical spray device. Pressure washers generally include a spray nozzle secured to an elongated wand. The nozzle functions to direct the spray onto a surface to be cleaned. Depending on a nozzle size attached to the device, it can be used as a low volume high-pressure cleaner or a high volume low pressure cleaner. In general, the device is employed to remove loose paint, mold, grime, dust, mud, and dirt from surfaces and objects. Resistance is communicated to the wand as a direct correlation to the pressure of the water exiting the nozzle. To overcome this resistance, an operator of the device must exert control over the wand. Whether applying the pressure washer from ground level or to a raised surface, the resistance has an effect on the operator and cleaning of the surface(s).

SUMMARY OF THE INVENTION

The present invention relates to an apparatus for cleaning a secondary surface. In one aspect, an apparatus is provided with a first body having first and second oppositely disposed walls, and a third wall substantially perpendicular to the first and second walls. An aperture is formed in the third wall and is adapted to receive a spray nozzle. A first rolling element is provided and extends between the first and second walls, and is also substantially oppositely disposed to the third wall. A set of guide posts are provided in communication with the first and second walls. More specifically, a first guide post is provided in communication with the first wall and a second guide post is provided in communication with the second wall. The first and second guide posts extend distally from the position of the first rolling element. An open area is formed between the first and second walls; the open area extends from the third wall to the first rolling element. The aperture supports freedom of movement of the spray nozzle within the aperture with discharge of a spray from the nozzle extending along a range defined by the open area. More specifically, as the first rolling element is applied to a secondary surface between the first and second guide posts, the first guide post communicates with a first side wall area of the secondary surface and the second guide post communicates with a second side wall area of the secondary surface.

In another aspect, an apparatus is provided with a first body having first and second oppositely disposed walls. The body is further provided with a third wall substantially perpendicular to the first and second walls, and an aperture formed in the third wall. A shaft is provided that extends between the first and second walls and is substantially oppositely disposed to the third wall. The shaft is a single body and has a first end and a second ends spaced between the first and second walls; the first end of the shaft is in relative communication with the first wall and the second end of the shaft is in relative communication with the second wall. A first rolling element is provided substantially concentric to the shaft, and extends around an exterior circumference of the shaft. The rolling element is configured to rotate along a first axis that is substantially perpendicular to the third wall.

Other features and advantages of this invention will become apparent from the following detailed description of the presently preferred embodiments of the invention taken in conjunction with the accompanying drawings.

Figure 1:
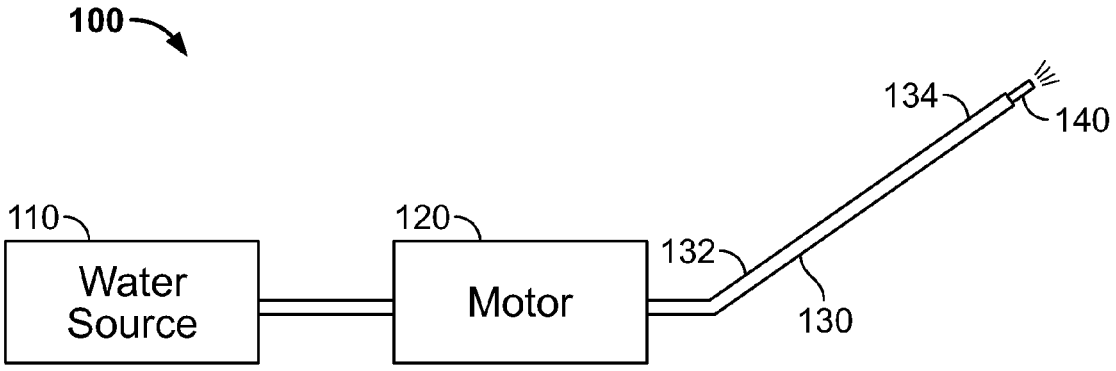
FIG. 1 (Prior Art)
FIG. 1 is a block diagram of a prior art pressure washer.

The drawings referenced herein form a part of the specification. Features shown in the drawings are meant as illustrative of only some embodiments of the invention, and not of all embodiments of the invention unless otherwise explicitly indicated. Implications to the contrary are otherwise not to be made.

DETAILED DESCRIPTION

Pressure washers are employed to clean secondary surfaces with the use of a high pressure liquid spray. FIG. 1 is a block diagram (100) of a prior art pressure washer. As shown, there are three primary components, including a water source (110), a motor (120), and a wand (130). The motor (120) receives water, or an alternative liquid, from a water source (110). In one embodiment, the pressure of the water as it enters the motor (120) at a first pressure level, and exits the motor at a higher pressure level. During use, water exits the motor and is received by the wand (130). More specifically, a first end of the wand (132) is in communication with the motor (120), and a second end of the wand (134) is in communication with a nozzle (140). In one embodiment, an operator maintains contact with the wand (130) during use of the pressure washer (100). Water exits the pressure washer via the nozzle (140), and the pressure of the water exiting the nozzle forms a water jet. The pressure at which the water jet comes into contact with a secondary surface removes dirt and grime from the secondary surface.

One side effect of the high pressure is the feedback exerted on the wand. To maintain control on the spray via the wand, force must be employed by an operator on the wand. This force is known to cause fatigue in the operator. Accordingly, there is a need to mitigate the effect of fatigue while maintaining control of the spray exiting the nozzle.

It will be readily understood that the components of the present invention, as generally described and illustrated in the Figures herein, may be arranged and designed in a wide variety of different configurations. Thus, the following more detailed description of the embodiments of the apparatus, system, and method of the present invention, as presented in the Figures, is not intended to limit the scope of the invention, as claimed, but is merely representative of selected embodiments of the invention.

Reference throughout this specification to "a select embodiment," "one embodiment," or "an embodiment" means that a particular feature, structure, or characteristic described in connection with the embodiment is included in at least one embodiment of the present invention. Thus, appearances of the phrases "a select embodiment," "in one embodiment," or "in an embodiment" in various places throughout this specification are not necessarily all referring to the same embodiment.

Furthermore, the described features, structures, or characteristics may be combined in any suitable manner in one or more embodiments. In the following description, numerous specific details are provided to demonstrate a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

The illustrated embodiments of the invention will be best understood by reference to the drawings, wherein like parts are designated by like numerals throughout. The following description is intended only by way of example, and simply illustrates certain selected embodiments of devices, systems, and processes that are consistent with the invention as claimed herein.

Figure 2:
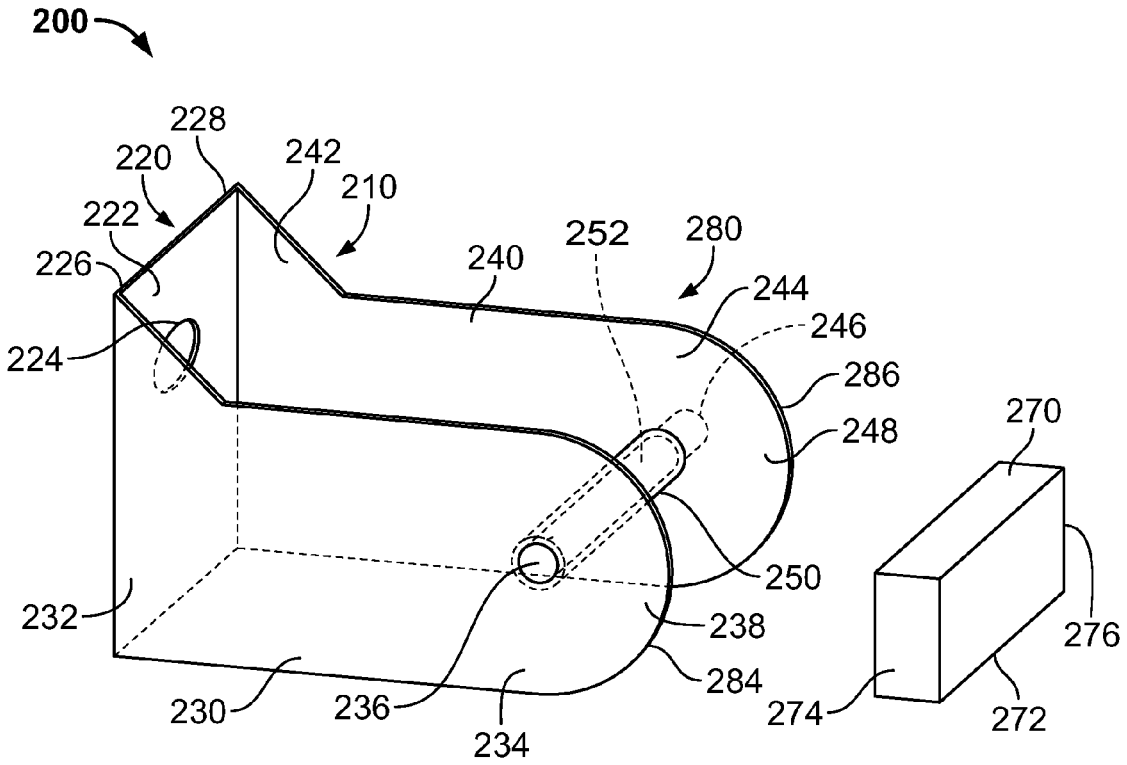
FIG. 2 is a front perspective view of one embodiment of the attachment.

A power washer attachment, hereinafter referred to as an attachment, of the invention is illustrated in FIG. 2. More specifically, FIG. 2 is a front perspective view of one embodiment of the attachment (200). As shown, the attachment (200) includes a body (210) having a first end (220) and a second end (280). The first end (220) includes a first wall (222) with an aperture (224) formed therein. In one embodiment, the aperture (224) is sized to receive a nozzle from a pressure washer. The first wall (222) includes two oppositely disposed ends, including a first end (226) and second end (228). Second and third walls (230) and (240), respectively, are provided adjacent to the first wall (222). More specifically, each of the second and third walls (230) and (240), respectively, has a first end (232) and (242), respectively, and a second end (234) and (244), respectively. The first ends (232) and (234) are adjacently positioned to the first and second ends (226) and (228), respectively, of the first wall (222). The second and third walls (230) and (240) are parallel or substantially parallel to each other.

The second ends (234) and (244) are remotely positioned from the first wall (222). Each of the second ends (234) and (244) includes a second aperture (236) and (246). As shown, a rolling element (250) is positioned across the second apertures (236) and (246). In one embodiment, a support or shaft (252) extends across the apertures (236) and (246) and the rolling element (250) rotates about the axis of the support (252) with freedom of movement of the rolling element (250) extending up to 360 degrees. In one embodiment, the rolling element (250) may roll, slide, rotate, etc. about the axis of the shaft (252). The freedom of movement mitigates friction from the rolling element (250) as it is applied to a secondary surface. In one embodiment, the contact of the rolling element (250) with the secondary surface provides set distance between the nozzle of the pressure washer and the secondary surface to mitigate damage to the secondary surface that may be caused by pressure of liquid from the nozzle. Similarly, in one embodiment, the contact of the rolling element (250) as it is applied to the secondary surface provides guidance of the nozzle in relation to the intended secondary surface with limited effort.

The rolling element (250) is positioned at a different vertical rise than the aperture (224). This is clearly shown in the front elevation view and described in FIG. 3. The second apertures (236) and (246) are not positioned at a distal end of the second and third walls (230) and (240). Rather, a segment (238) and (248) is provided between the second apertures (236) and (246), respectively, and the second ends (234) and (244) of the second and third walls (230) and (240), respectively. The segments (238) and (248) function together as a guide to facilitate movement of the attachment (200) along a secondary surface (270). The attachment (200) shown in FIG. 2 is configured to communicate with the secondary surface (270) having a width defined as (272). In one embodiment, the secondary surface is a planar surface having a width (272) which is less than a width defined by the distance between the second and third walls (230) and (240). Upon application of the attachment (200) to the secondary surface (270), the rolling element (250) communicates with the secondary surface (270). At the same time, the planar secondary surface (270) has a defined width (272) with associated walls (274) and (276). Segment (238) is in communication with wall (274) and segment (248) is in communication with wall (276). Accordingly, the segments (238) and (248) function together as guide posts to retain the attachment device (200) in position as the rolling element (250) rotates along the secondary surface (270).

As shown, the distal ends (280) of the second and third walls (230) and (240), respectively, are shown with a rounded surface. The attachment (200) is configured to clean the secondary surface (270) by placement of a high pressure nozzle (not shown) in the aperture (224). The rolling element (250) contacts the secondary surface (270) and enables the attachment device (200) to glide along the secondary surface (270). By configuring the distal ends (280) with rounded surfaces (284) and (286), respectively, the ability for the distal ends (280) to poke or otherwise damage the secondary surface is mitigated. In one embodiment, a soft material may be applied to the surfaces (284) and (286) to further mitigate the opportunity for frictional damage to the secondary surface (270).

Figure 3:
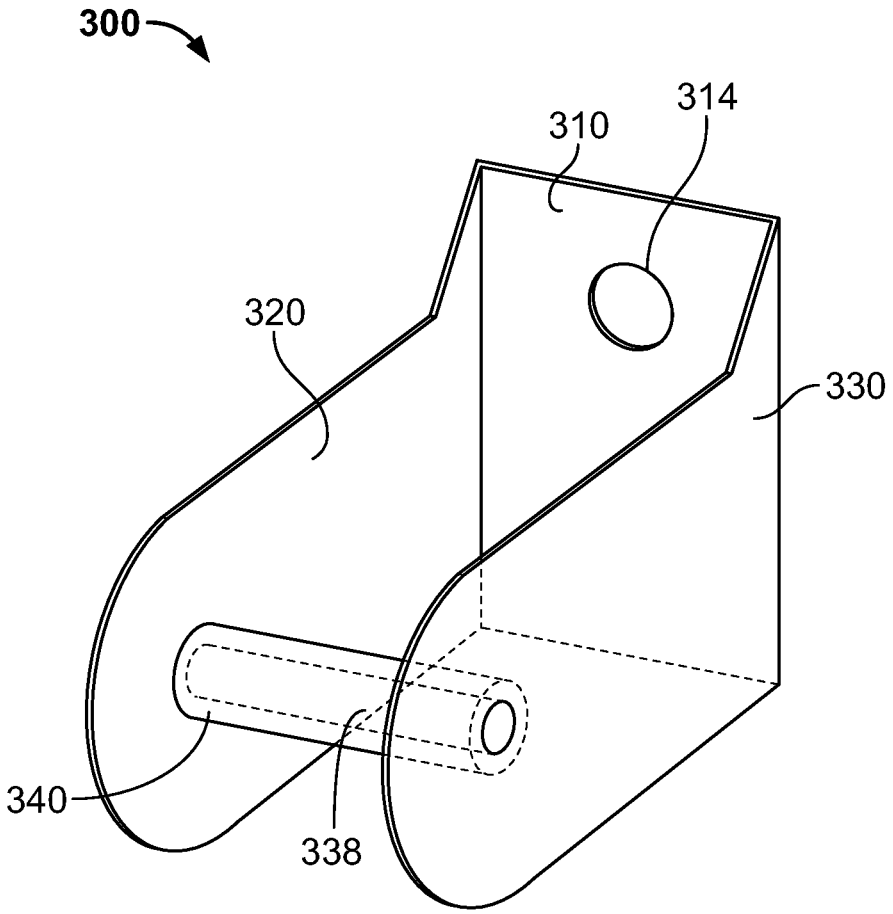
FIG. 3 is a front elevation view of the attachment.

FIG. 3 is a front elevation view (300) of the attachment. As shown, there is a central vertical wall (310) with an aperture (314) thereon. Two side walls (320) and (330) are provided in communication with the central vertical wall (310). A shaft (338) extends between the two side walls (320) and (330), and a rolling element (340) extends over a substantial length of the shaft (338). In one embodiment, the rolling element (340) is substantially concentric with the shaft (338). The rolling apparatus (340) is provided extending the length between the two side walls (320) and (330). The aperture (314) is at a first height relative to the length of the central vertical wall (310), and the rolling element (340) is at a second height relative to the length of the central vertical wall (310). The first height and the second height are different positions. More specifically, by positioning the aperture (314) and the rolling element (340) at different heights, the rolling element (340) will not obstruct liquid discharged from the aperture (314) from reaching the surface that the liquid is intended to reach. Accordingly, the front elevation view demonstrates the position of the aperture (314) relative to the position of the rolling element (340).

As shown in FIGS. 2 and 3, there is a fixed distance between the opposing walls of the attachment. This fixed distance provides stability as the rolling element is applied to a secondary surface with the guide posts wrapping the side walls of the secondary surface. In one embodiment, a high pressure water nozzle is placed in the aperture so that water is ejected in the direction of the rolling element and makes contact with the secondary surface. The rolling element enables the attachment to move about the vertical height of the secondary surface with the liquid ejecting from the nozzle and aperture to clean the secondary surface through the pressure of the liquid.

Figure 4:
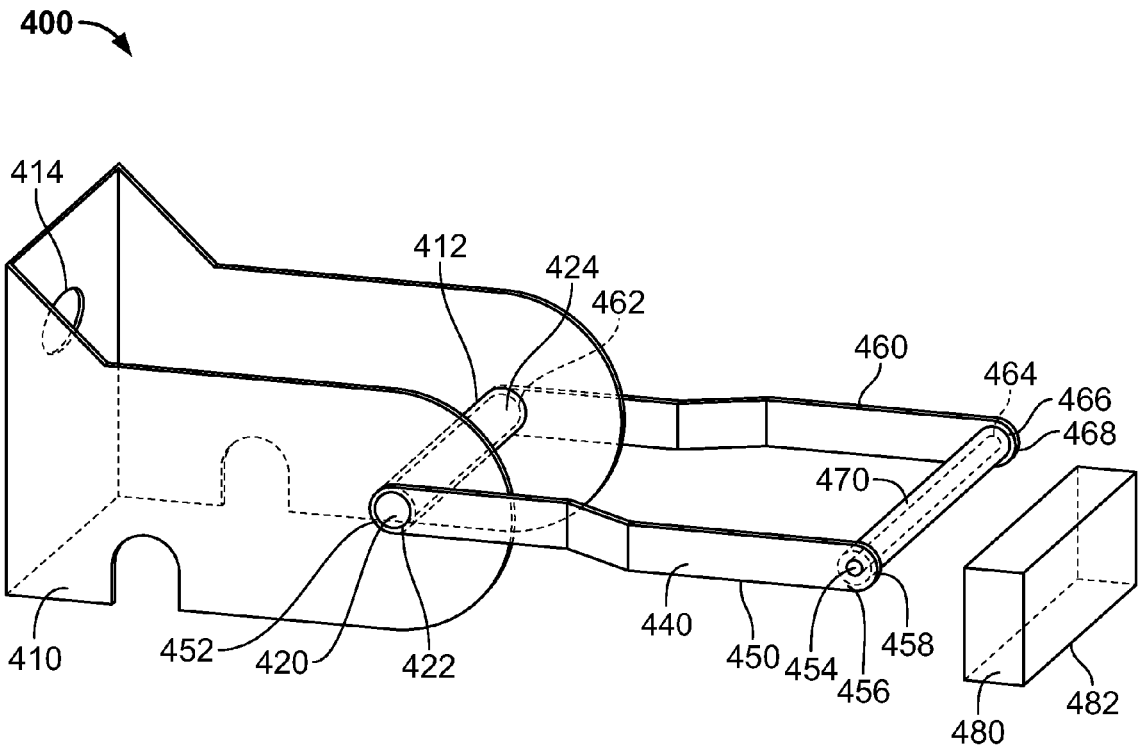
FIG. 4 is a front perspective view of the attachment device and an associated extension.

FIG. 4 is a front perspective view (400) of the attachment device and an associated extension. The extension may be required for various purposes, including but not limited to an increased distance from the aperture to the secondary surface, and a different width measurement of the secondary surface. As shown, a base attachment device (410) is provided that is equivalent to the attachment device (200). The differences emanate with a first rolling element (412). A securing element (420) is provided to attach the rolling element to the attachment device (400). An aperture (414) is provided in a wall positioned and spaced apart from the first rolling element (412). More specifically, a set of secondary apertures (422) and (424) are provided with the side walls of the base attachment device (410). The first rolling element (412) is secured to the attachment device by fastening elements. An extension (440) is provided and secured to the first attachment device (410). As shown, the attachment of the extension (440) to the first attachment device (410) takes place adjacent to the set of secondary apertures (422) and (424). Accordingly, the physical structure of the first attachment device is not modified to receive the extension (440).

The extension (440) is comprised of two oppositely disposed side walls (450) and (460). Each of the oppositely disposed walls is shown with two apertures. More specifically, a first wall (450) has apertures (452) and (454), and a second wall (460) has apertures (462) and (464). The first apertures (452) and (462) are secured to the base attachment device (410) adjacent to the first rolling element (412). The second apertures (462) and (464) are provided with a second rolling element (470) there between. In one embodiment, a set of second fastening elements (not shown) is provided to secure the second rolling element (470) to each of the second apertures (462) and (464).

The extension (440) shown in FIG. 4 is configured to communicate with a secondary surface (480) having a width defined as (482). In one embodiment, the secondary surface is a planar surface having the width (482) less than a width defined by the distance between the oppositely disposed walls (450) and (460). Upon application of the extension (440) to the secondary surface (480), the second rolling element (470) communicates with the secondary surface (480). Two secondary segments (456) and (466) are provided on the oppositely disposed side walls (450) and (460), respectively. The two secondary segments (456) and (466) are defined by the distance between the second rolling element (470) and distal ends (458) and (468) of each of the side walls (450) and (460), respectively. When the second rolling element (470) is in contact with the secondary surface (480), the secondary segments (456) and (466), which function as guide posts, provide stability for the attachment and the associated extension (440) and effectively guide the attachment device along the secondary surface. Accordingly, the extension (440) enables the attachment device to accommodate secondary surfaces having different dimensions while continuing to function as a stability and guide member.

As shown in FIG. 4, the extension (440) is shown in an extended layout illustrating an extended length provided to the attachment device. In the embodiment, shown, the secondary surface (480) has a width larger than the width of the secondary surface (270) shown in FIG. 2. In one embodiment, the distance between the walls (450) and (460) may be narrower than the width between walls (230) and (240) with the secondary rolling element to accommodate a secondary surface with a width narrower than that defined by (230) and (240).

Figure 5:
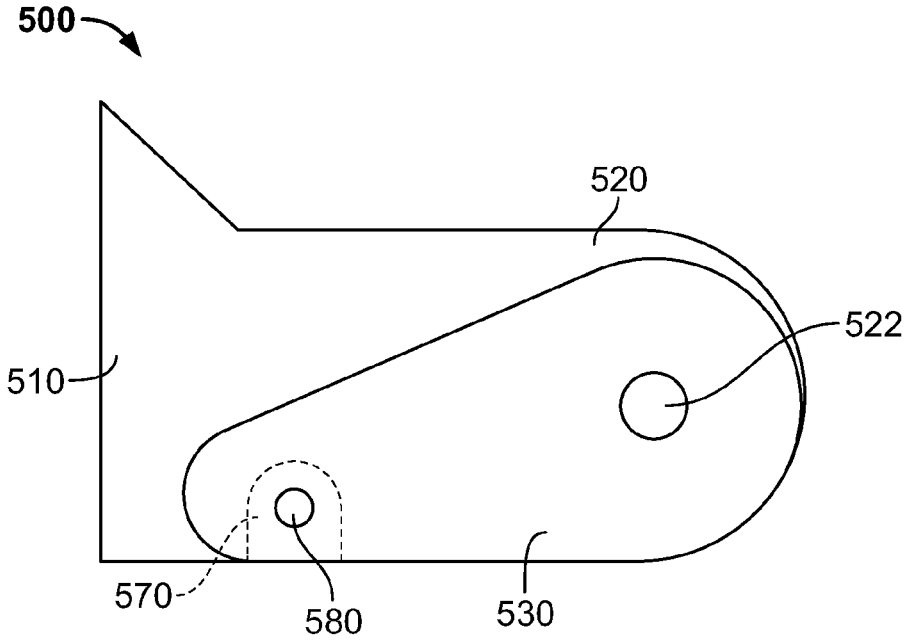
FIG. 5 is a side view of a body of the attachment device showing the extension in a stored format.

FIG. 5 is a side view (500) of a body of the attachment device showing the extension in a stored format, also known as a retracted position. As shown, the attachment device (510) has a side wall (520) with an aperture (522) to secure a rolling element to the attachment device (510). An oppositely disposed side wall is provided but not shown in this view. An attachment element (not shown), such as a mechanical attachment element, is provided to secure the rolling element to the device (510). At the same time, the same attachment element or a secondary attachment element is employed to secure an extension device (530) to the attachment device (510). In one embodiment, the extension device (530) is secured to the attachment device (510) through use of the aperture (522). The extension device (530) rotates about an axis of a shaft (not shown) secured through the aperture (522) between an extended position (see FIG. 4) and a retracted position.

As shown, a recess (570) is provided in the body of the attachment device (510). The recess (570) is sized and configured to hold the extension device (530) in the retracted position. When the extension device (530) is in the retracted position (560), the first rolling element (580) functions to contact a secondary surface. Conversely, when the extension device (530) is in the extended position (see FIG. 4), the second rolling element (as shown in FIG. 4) functions to contact the secondary surface. Accordingly, the recess (570) enables the extension device (530) to rotate about an axis of the attachment element between the retracted position and the extended position.

Figure 6:
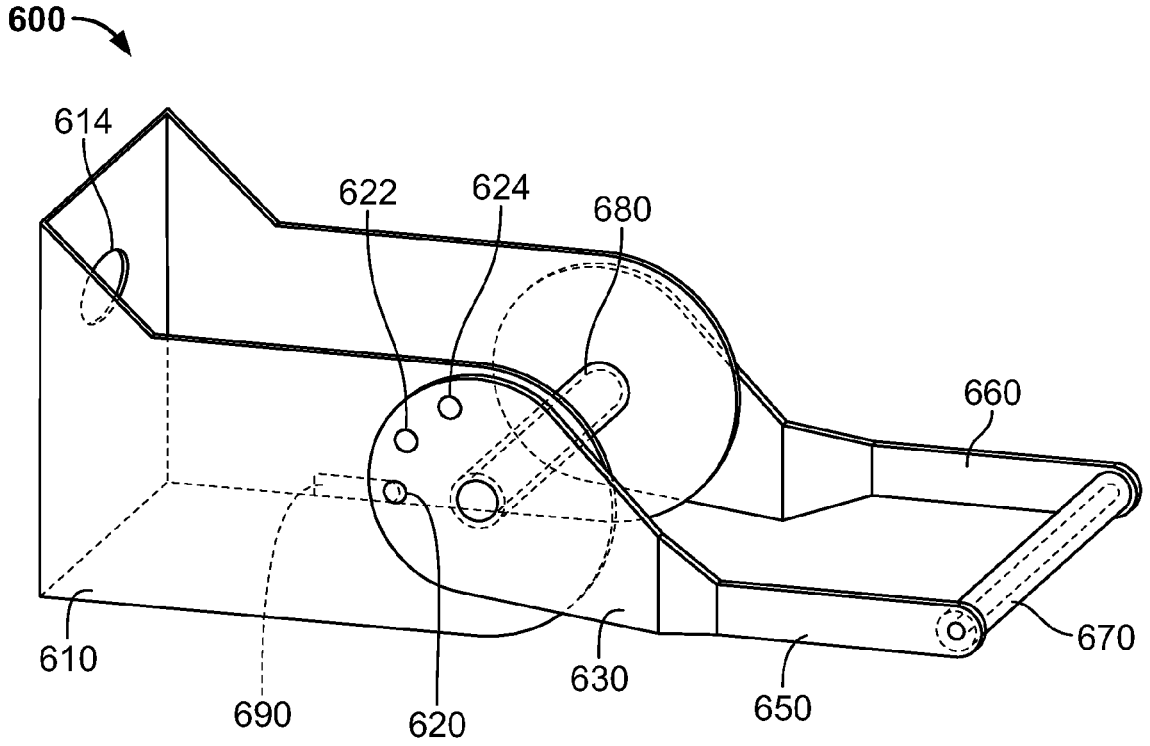
FIG. 6 is a front perspective view of the attachment device in communication with the extension device.

As shown and described in FIG. 5, an extension device (530) is provided to extend the functionality of the attachment device (510). FIG. 6 is a perspective view (600) of the attachment device (610) in communication with the extension device (630). The extension device (630) has two oppositely disposed side walls (650) and (660). A first end of the side walls (650) and (660) have a second rolling element (670) extending between the walls (650) and (660). In one embodiment, the second rolling element (670) is parallel to a first rolling element (680) of the attachment device (610). An aperture (614) is provided in a wall positioned and spaced apart from the first rolling element (680). A plurality of apertures (620), (622), and (624) is provided adjacent to a second end of one of the side walls (650). A lock (690) is provided on an interior surface of the side wall (650) and is configured to selectively communicate with apertures (620), (622), and (624). In one embodiment, the lock (690) is a spring lock. At such time as the lock (690) engages one of the apertures (620), (622), and (624) the extension device (630) is held in a fixed position relative to the attachment device (610). In one embodiment, an alternative securing element may be used in place of the lock (690), and as such, the invention should not be limited to this specific teaching. Accordingly, each of the apertures (620), (622), and (624) may be individually selected to hold the extension device (630) in a fixed position.

Different positions of the extension device (630) may be desirable for the relationship of the attachment device (610) to the secondary surface. For example, a first position defined by a first aperture (622) may be desirable for a level relationship, a second position defined by a second aperture (624) may be desirable for extending the device (610) in a raised position, a third position defined by a third aperture (620) may be desirable for extending the device (610) in an lowered position, etc. Although three apertures (620), (622), and (624) are shown herein, the invention should not be limited to this quantity or apertures and associated positions. In one embodiment, there may be additional apertures to define additional positions, respectively, or a decreased quantity of apertures. Accordingly, the lock (690) is employed to secure the extension device (630) in a fixed position with respect to the attachment device (610).

The present invention may be embodied in other specific forms without departing from its spirit or essential characteristics. The described embodiments are to be considered in all respects only as illustrative and not restrictive. Each of the embodiments describes a rolling element adapted to be applied to a secondary surface. The rolling element contacts the secondary surface and guides the liquid ejecting from a pressure washer to the secondary surface. The rolling element may take different forms, including but not limited to a roller to be applied to the secondary surface with minimal friction as it rolls along the secondary surface. The scope of the invention is, therefore, indicated by the appended claims rather than by the foregoing description. All changes which come within the meaning and range of equivalency of the claims are to be embraced within their scope. Accordingly, the scope of protection of this invention is limited only by the claims and their equivalents.

I claim:

1. An apparatus comprising:

a first body having first and second oppositely disposed walls, and a third wall substantially perpendicular to the second and second walls;

an aperture formed in the third wall and adapted to receive a spray nozzle;

a first rolling element extending between the first and second walls and substantially oppositely disposed to the third wall, and including a first guide post in communication with the first wall and a second guide post in communication with the second wall, the first and second guide posts extending distally from the position of the first rolling element;

an open area formed between the first and second walls, the open area extending from the third wall to the rolling element;

the aperture to support freedom of movement of the spray nozzle within the aperture with discharge of a spray from the nozzle extending along a range defined by the open area; and the first rolling element adapted to be applied to a secondary surface between the first and second guide posts, including the first guide post in communication with a first side wall area of the secondary surface and the second guide post in communication with a second side wall area of the secondary surface, with the first and second side wall areas being in a substantially parallel arrangement.

2. The apparatus of claim 1, wherein the first and second walls have a first height adjacent to the rolling element and a second height adjacent to the third wall, including the first height being less than the second height.

3. The apparatus of claim 2, further comprising the spray nozzle coupled to the aperture, wherein a trajectory of a liquid discharged from the spray nozzle extends above the first height.

4. The apparatus of claim 1, wherein a straight position of the spray nozzle in the aperture causes the spray discharge to extend over a top surface of the rolling element.

5. The apparatus of claim 1, further comprising a second body secured to the first body, the second body having an extended position and a retracted position.

6. The apparatus of claim 5, further comprising a recess formed in the first body to receive the second body in the retracted position.

7. The apparatus of claim 6, further comprising the second body having two oppositely disposed walls and a second rolling element extending between the two oppositely disposed walls.

8. The apparatus of claim 7, further comprising the recess to receive the second rolling element in the retracted position.

9. The apparatus of claim 7, further comprising the first rolling element parallel to the second rolling element.

10. The apparatus of claim 7, further comprising a secondary set of guide posts in communication with the second body and extending distally from the second rolling element.

11. The apparatus of claim 10, further comprising the second body in an extended position and the second rolling element to be applied to the secondary surface, and the secondary surface having a width equal to or less than a distance between the two oppositely disposed walls of the second body.

12. The apparatus of claim 7, further comprising an aperture formed in one of the two oppositely disposed walls and a locking spring in communication with the aperture, the locking spring to engage the aperture and hold the second rolling element in a fixed position.

13. An apparatus comprising:

a first body having first and second oppositely disposed walls, and a third wall substantially perpendicular to the second and second walls;

an aperture formed in the third wall;

a shaft extending between the first and second walls and substantially oppositely disposed to the third wall;

the shaft being a single body have a first end and a second end spaced between the first and second walls, with the first end in relative communication with the first wall and the second end in relative communication with the second wall;

a rolling element substantial concentric to the shaft and to extend around an exterior circumference of the shaft, the rolling element to rotate along a first axis, the first axis substantially perpendicular to the third wall; and a first guide post in communication with the first wall and a second guide post in communication with the second wall, the first and second guide posts extending distally from the position of the rolling element.

14. The apparatus of claim 13, further comprising the first rolling element adapted to be applied to a secondary surface between the first and second guide posts, including the first guide post in adjacently positioned with a first side wall area of a secondary surface and the second guide post adjacently positioned with a second side wall area of the secondary surface, with the first and second side wall areas being in a substantially parallel arrangement.

15. The apparatus of claim 14, further comprising a second body secured to the first body, the second body having two oppositely disposed walls and a second rolling element extending between the two oppositely disposed walls.

16. The apparatus of claim 15, further comprising the second body having an extended position, wherein the extended position includes the first rolling element parallel to the second rolling element.

17. The apparatus of claim 15, further comprising the second body having a retracted position, including a recess in the first and second walls of the first body adapted to receive and secure the two oppositely disposed walls of the second body.

18. The apparatus of claim 15, further comprising a secondary set of guide posts in communication with the second body and extending distally from the second rolling element.

19. The apparatus of claim 14, further comprising the second body in an extended position and the second rolling element to be applied to the secondary surface, and the secondary surface having a width equal to or less than a distance between the two oppositely disposed walls of the second body.

20. The apparatus of claim 15, further comprising an aperture formed in one of the two oppositely disposed walls and a locking spring in communication with the aperture, the locking spring to engage the aperture and hold the second rolling element in a fixed position.

* * * * *